US006260861B1

(12) United States Patent
Chiang et al.

(10) Patent No.: US 6,260,861 B1
(45) **Date of Patent: *Jul. 17, 2001**

(54) VARIABLE TRACTION WHEEL FOR IN-LINE ROLLER SKATE

(75) Inventors: Albert C. Chiang, Danbury, CT (US); John A. Roderick, Scituate, RI (US); David R. Willis, Wakefield, RI (US); Charles Sipes, Johnston, RI (US)

(73) Assignee: Mearthane Products Corporation, Cranston, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/185,409

(22) Filed: Nov. 3, 1998

Related U.S. Application Data

(63) Continuation of application No. 08/730,469, filed on Oct. 11, 1996, now Pat. No. 5,829,757.

(51) Int. Cl.[7] ..... A63C 17/22

(52) U.S. Cl. ..... 280/11.221; 280/11.231; 301/5.3

(58) Field of Search ..... 280/11.22, 11.23, 280/11.19, 11.221, 11.226, 11.227, 11.231; 301/5.3, 64.7; 152/11, 12

(56) References Cited

U.S. PATENT DOCUMENTS

| | | | |
|---|---|---|---|
| 3,287,023 | | 11/1966 | Ware . |
| 4,699,432 | | 10/1987 | Klamer . |
| 5,028,058 | | 7/1991 | Olson . |
| 5,129,709 | * | 7/1992 | Klamer . |
| 5,135,244 | * | 8/1992 | Allison . |
| 5,171,032 | * | 12/1992 | Dettmer . |
| 5,183,275 | * | 2/1993 | Hoskin . |
| 5,197,572 | * | 3/1993 | Roberts . |
| 5,207,438 | * | 5/1993 | Landers . |
| 5,401,037 | * | 3/1995 | O'Donnell et al. . |
| 5,503,466 | | 4/1996 | Lew . |
| 5,527,100 | * | 6/1996 | O'Connell et al. . |

FOREIGN PATENT DOCUMENTS

| | | |
|---|---|---|
| 0 714 682 A2 | 6/1996 | (EP) . |
| WO 96/20030 | 7/1996 | (WO) . |
| PCT/US97/17209 | 2/1998 | (WO) . |

* cited by examiner

*Primary Examiner*—Richard M. Camby
(74) *Attorney, Agent, or Firm*—Fish & Richardson P.C.

(57) ABSTRACT

Disclosed is an in-line skate wheel that includes: (a) a braking portion including a high friction surface material having a hardness from about 75 to about 95 Shore A, and a coefficient of friction from about 0.45 to about 1.5; and (b) a skating portion including a low friction surface material having a hardness from about 75 to about 95 Shore A, and a coefficient of friction from about 0.1 to about 0.45. The skating portion includes a higher proportion of low friction surface material than the braking portion. The wheel delivers variable traction in response to the angle of wheel contact with the ground, without sacrificing a smooth ride or wheel durability. Utilizing the variable traction of the wheel a skater can stop safely and reliably, using known ice-skating maneuvers, wherein the wheel is turned away from the skater's direction of travel.

19 Claims, 9 Drawing Sheets

VARIABLE TRACTION WHEEL FOR IN-LINE ROLLER SKATE

This application is a continustion of Ser. No. 08/730,469 filed Oct. 11, 1996 now Pat. No. 5,829,757.

FIELD OF THE INVENTION

The invention relates to in-line roller skates.

BACKGROUND OF THE INVENTION

Despite the growing popularity of in-line skating, and advances in in-line skate technology, rapid, controlled stopping has continued to present a problem for skaters of all skill levels. Various stopping devices have been employed on in-line skates, e.g., a braking system located on the toe of the skate (Landers, U.S. Pat. No. 5,207,438), a replaceable brake pad located at the rear of the skate (Roberts, U.S. Pat. No. 5,197,572), and a spring-loaded friction device that engages a skate wheel (Allison, U.S. Pat. No. 5,135,244).

O'Donnell et al. (U.S. Pat. No. 5,401,037) discloses a composite wheel for an in-line skate. The O'Donnell wheel includes a center section made of a hard material having a low coefficient of friction, e.g., high density polyethylene. The center section of the wheel is flanked by side sections made of a relatively soft material having a high coefficient of friction, e.g., cast polyurethane. To stop or reduce speed, a skater using the O'Donnell wheel turns the skates away from the direction of travel, and leans away from the direction of travel, as if on ice skates. This causes a portion of the soft material to engage the ground and generate friction.

SUMMARY OF THE INVENTION

Generally, the invention features an in-line skate wheel that delivers variable traction in response to wheel angle, without sacrificing a smooth ride or wheel durability. Utilizing the variable traction of the wheel, an in-line roller skater can stop safely and reliably. The skater does so in a maneuver similar to an ice-skating maneuver known as the hockey stop. Utilizing the variable traction of the wheel, the snow plow maneuver, which involves turning the toes of both feet inward, to slow forward or backward speed, can also be executed safely and effectively.

The wheel includes: (a) a braking portion including a high friction surface material having a hardness from about 75 to about 95 Shore A, and a coefficient of friction from about 0.45 to about 1.5; and (b) a skating portion including a low friction surface material having a hardness from about 75 to about 95 Shore A, and a coefficient of friction from about 0.1 to about 0.45. The skating portion includes a higher proportion of low friction surface material than the braking portion. Typically, the low friction surface material is arranged around the entire circumference of the wheel.

As a skater initiates a hockey stop, the skating surface of the wheel is in contact with the ground, and the low friction surface material enables the skate to skid or slide momentarily. This momentary sliding prevents the skater from pitching forward uncontrollably. The skater then quickly and smoothly engages the braking surface against the ground. This quickly stops the skater, without loss of balance.

The low friction material and high friction material are similar in hardness. The nearly uniform hardness of the wheel's surface avoids clattering or vibration caused by alternating contact of a hard material and a soft material with the ground. The nearly uniform hardness also inhibits initiation and propagation of tearing.

Preferably, the high friction surface material includes a castable thermoset polymer resin containing an isocyanate-reactive functional group, and the low friction surface material includes a thermoplastic polymer resin containing an isocyanate-reactive functional group. The castable thermoset polymer resin can be cast around the thermoplastic polymer resin. The castable thermoset polymer resin can be, for example, castable thermoset polyurethane, and the thermoplastic polymer resin can be an injection-molded thermoplastic polyurethane.

Preferably, the castable thermoset polyurethane and the injection-molded thermoplastic polyurethane are durably joined, for example,-by covalent bonds. The covalent bonds include, for example, urea linkages or urethane linkages.

The low friction surface material can be in the form of floating insets. The floating insets can be, for example, rods, tubes, or fiber bundles. Alternatively, the low friction surface material can be an inner ring with spokes radiating from the inner ring to the surface of the skating portion of the wheel.

The invention also features a method of making a wheel for an in-line roller skate. The method includes the steps of: (a) providing in a casting mold a low friction surface material consisting of a thermoplastic polymer resin that has a hardness from about 75 Shore A to about 95 Shore A, has a coefficient of friction from about 0.1 to about 0.45, and contains an isocyanate-reactive functional group; and (b) placing into the mold a mixture of a bifunctional isocyanate and a polyol under conditions suitable for polymerization into a thermoset polyurethane having a hardness from about 75 to about 95 Shore A and a coefficient of friction from about 0.45 to about 1.5. The thermoplastic resin can be, for example, thermoplastic polyurethane. The bifunctional isocyanate can be, for example, MDI. The polyol can be, for example, polytetrahydrofuran polyol.

The invention also features an in-line roller skate. The skate includes: (a) a boot; (b) a wheel-mounting frame; and (c) a wheel including: (1) a braking portion including a high friction surface material having a hardness from about 75 to about 95 Shore A, and a coefficient of friction from about 0.45 to about 1.5; and (2) a skating portion including a low friction surface material having a hardness from about 75 to about 95 Shore A, and a coefficient of friction from about 0.1 to about 0.45 Shore A; wherein the skating portion includes a higher proportion of low friction surface material than the braking portions.

As used herein, "braking portion" means the portion of the wheel that can contact the ground during a hockey stop.

As used herein, "coefficient of friction" means a coefficient measured using a normal force (90° angle) of 0.5 pound, against 20-pound bond paper, using an Instron device adjusted to a head speed of 20 inches per minute.

As used herein, "durably joined" materials means materials joined with a bond strength greater than about 50 pounds per linear inch (pli). The pli value is determined according to ASTM D429 method B, modified so that stripping force is applied at an angle of 180° instead of 90°, and Instron head speed is 2 inches per minute. Typically, durably joined materials are joined with a bond strength of greater than about 75 pli.

As used herein, "floating inset" means an inset that is not connected to other insets, either directly, or via an inner ring or hub.

As used herein, "high friction surface material" means a material that has a coefficient of friction from about 0.45 to about 1.5, and is exposed on the surface of a wheel.

As used herein, "isocyanate-reactive" functional group means a functional group that reacts with an isocyanate.

Exemplary isocyanate-reactive functional groups are amino groups, amide groups, and hydroxyl groups. Exemplary isocyanates are MDI and TDI.

As used herein, "low friction surface material" means a material that has a coefficient of friction from about 0.1 to about 0.45, and is exposed on the surface of a wheel.

As used herein, "MDI" means a mixture of 4,4'- and 2,4'-diisocyanato diphenylmethane.

As used herein, "skating portion" of a wheel means the portion of the wheel that contacts the ground when the wheel is rolling substantially straight forward or substantially straight backward, during normal skating.

As used herein, "TDI" means a mixture of 2,4- and 2,6-toluene diisocyanate.

As used herein, "thermoplastic polymer resin" means a polymer resin that can be melted or softened in the polymerized form.

As used herein, "thermoset polymer resin" means a polymer resin that decomposes before melting, upon application of heat.

All patents mentioned herein are incorporated by reference in their entirety.

Various features and advantages of the invention will be apparent from the following detailed description and from the claims.

BRIEF DESCRIPTION OF THE DRAWING

FIG. 2A depicts low friction surface material in a 14-spoke angled arrangement.

FIG. 3A depicts low friction surface material in an open tube honeycomb arrangement.

FIG. 4A depicts low friction surface material in a hollow tube spoke arrangement.

FIG. 5A depicts low friction surface material in an impact absorbing arrangement.

FIG. 6A depicts low friction surface material in a triangle spoke angled arrangement.

FIG. 7A depicts low friction surface material in a radial orientation fiber arrangement.

FIG. 8A depicts low friction surface material in a 14-spoke straight arrangement.

DETAILED DESCRIPTION

Figure 1:
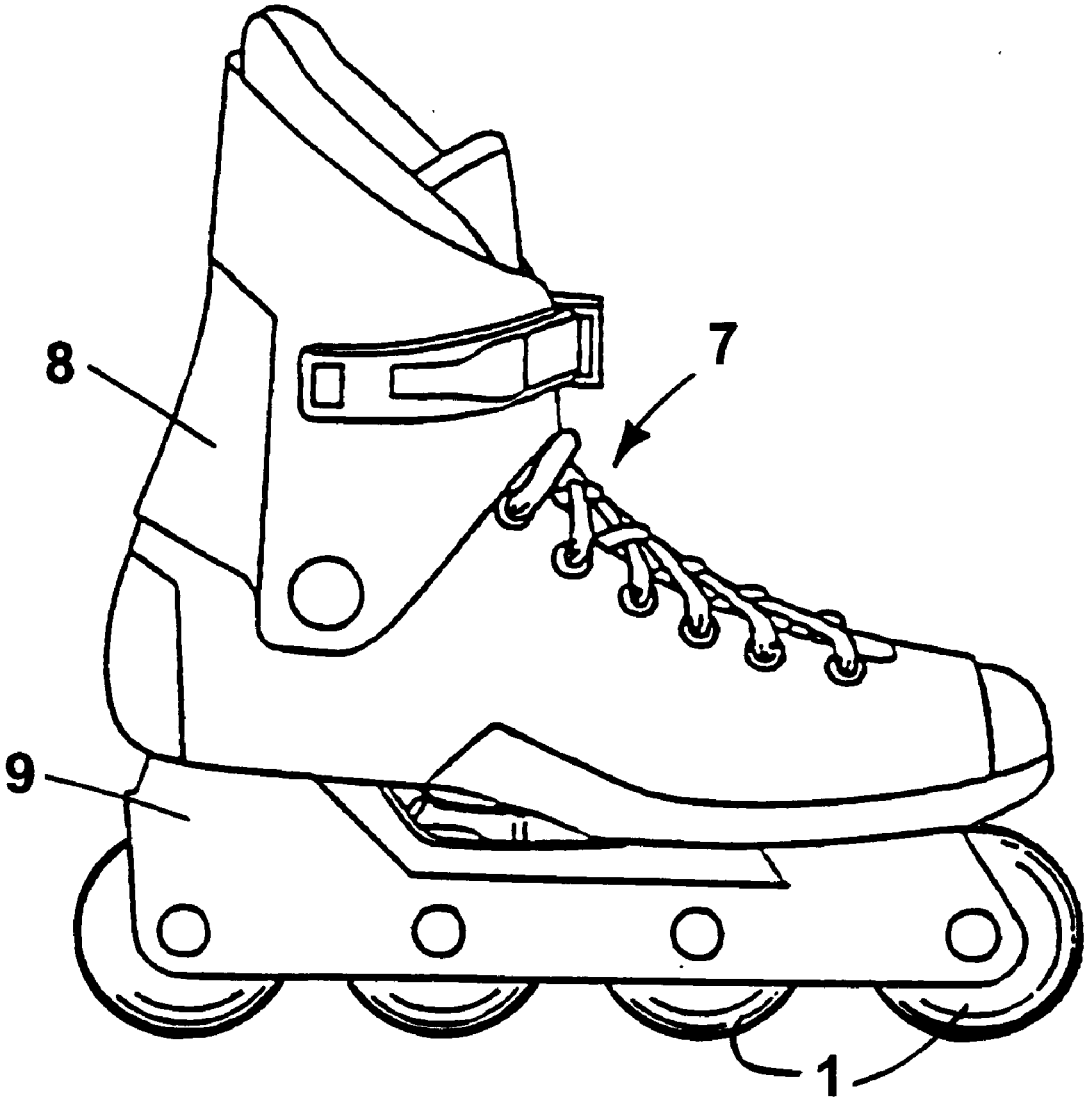
FIG. 1 is a perspective view of an in-line roller skate with variable traction wheels in accordance with the invention.

An in-line roller skate in accordance with this invention is shown in FIG. 1. The skate 7 includes a boot 8, a wheel-mounting frame 9, and wheels 1.

Figure 2B:
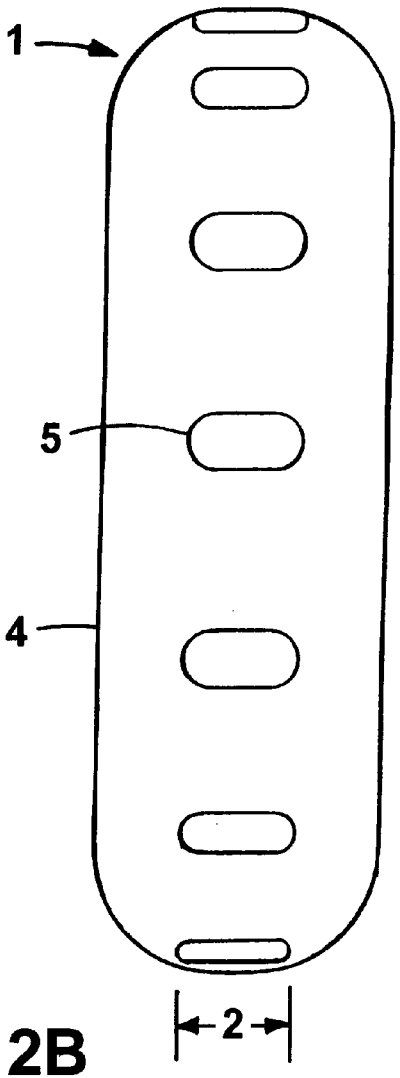
FIG. 2B is an axial plan view of the wheel depicted in FIG. 2A.
Figure 2A:
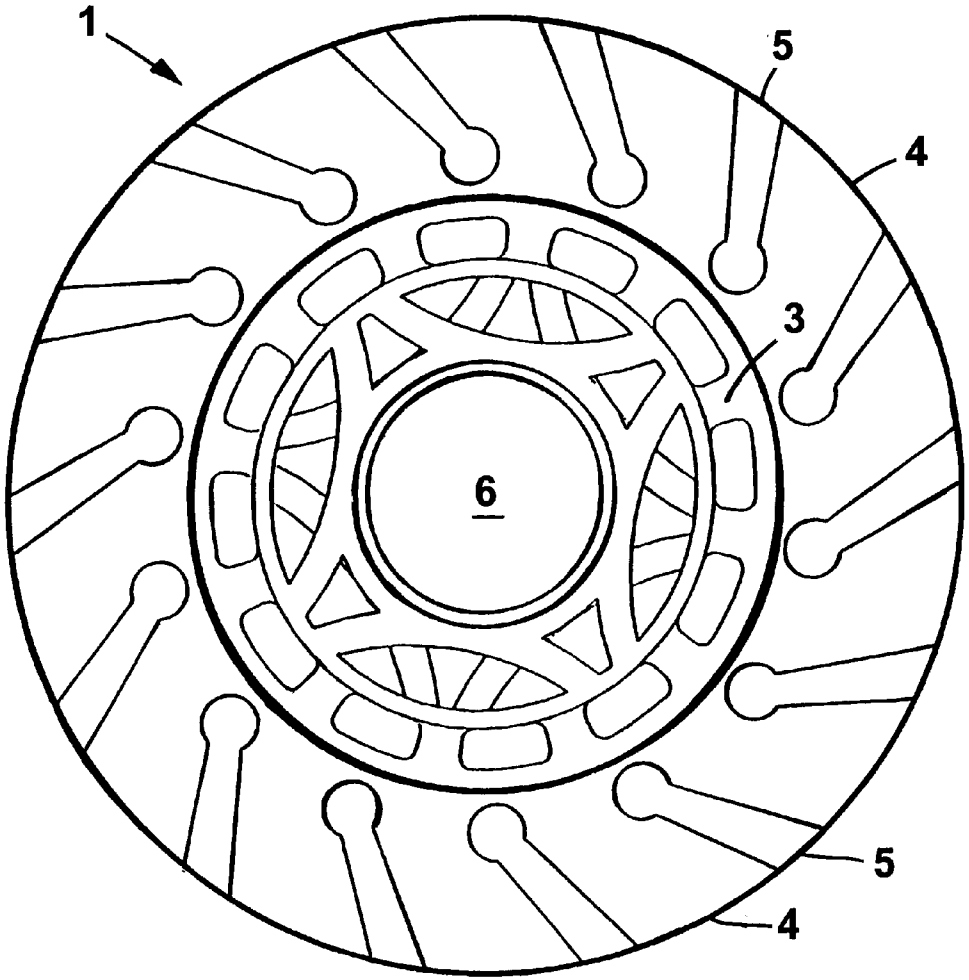
FIG. 2A is a radial cross-section of an in-line skate wheel of the present invention.
Figure 3B:
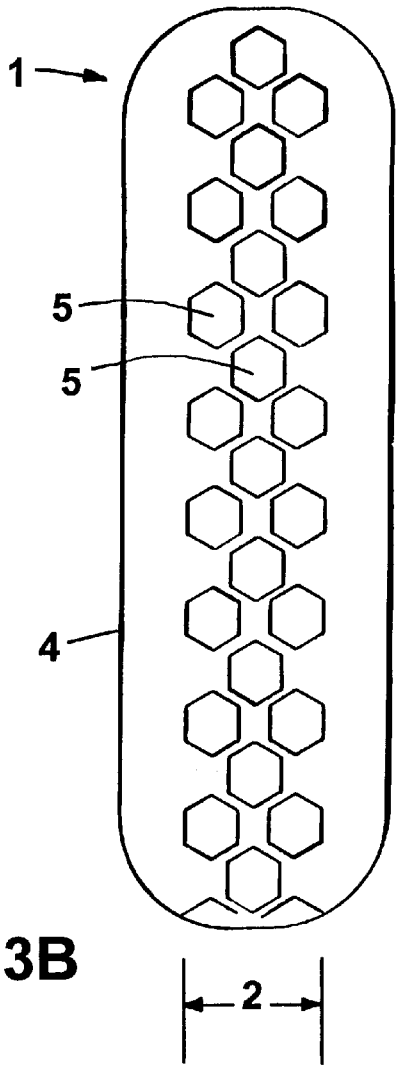
FIG. 3B is an axial plan view of the wheel depicted in FIG. 3A.
Figure 3A:
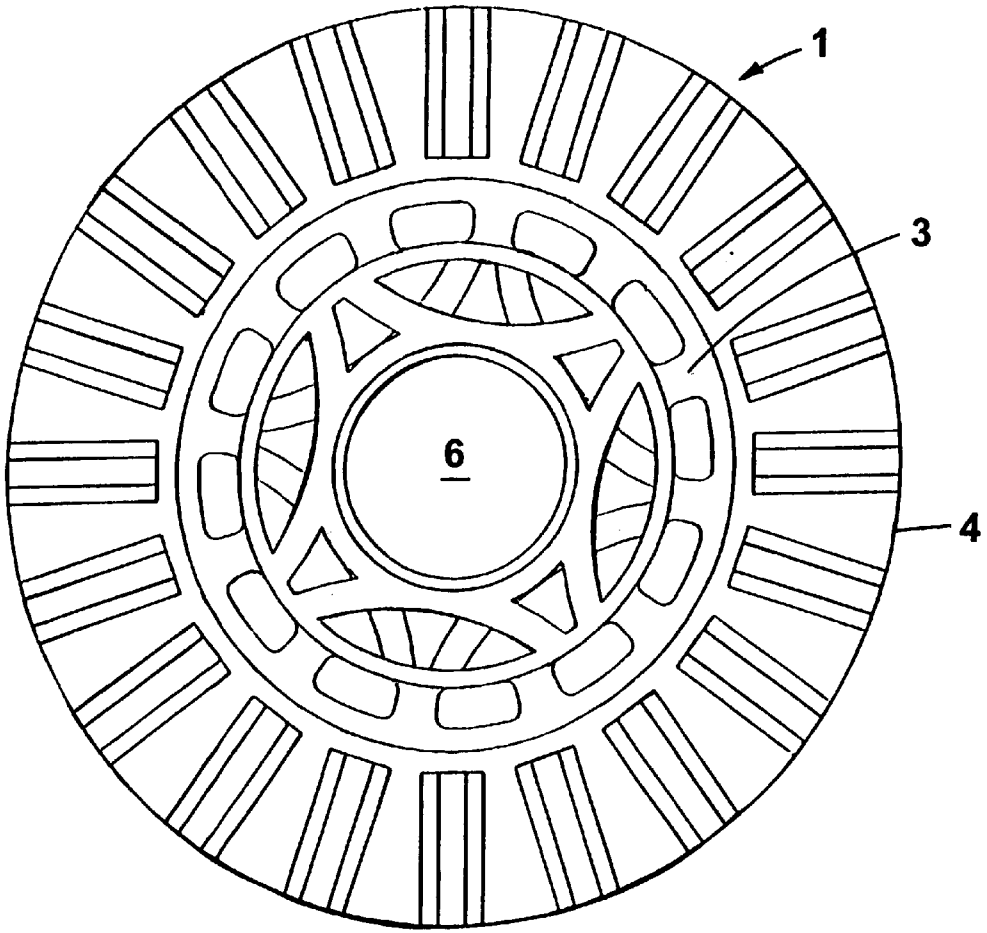
FIG. 3A is a radial cross-section of an in-line skate wheel of the present invention.
Figure 4B:
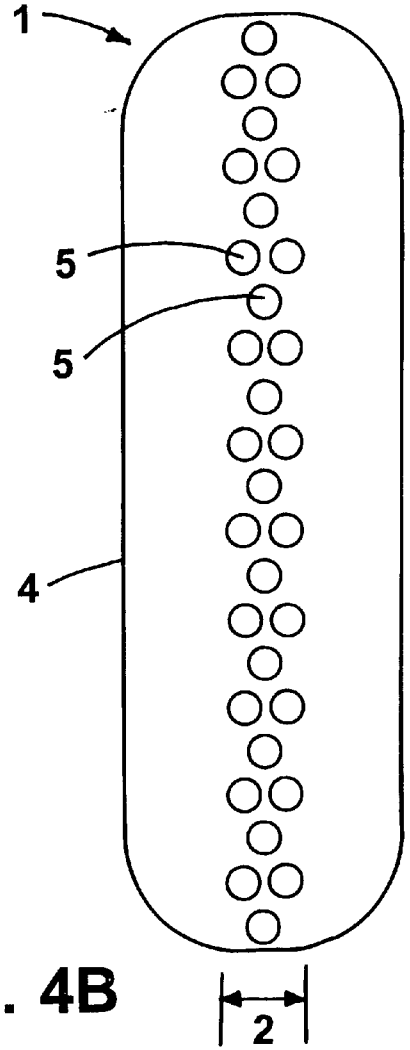
FIG. 4B is an axial plan view of the wheel depicted in FIG. 4A.
Figure 4A:
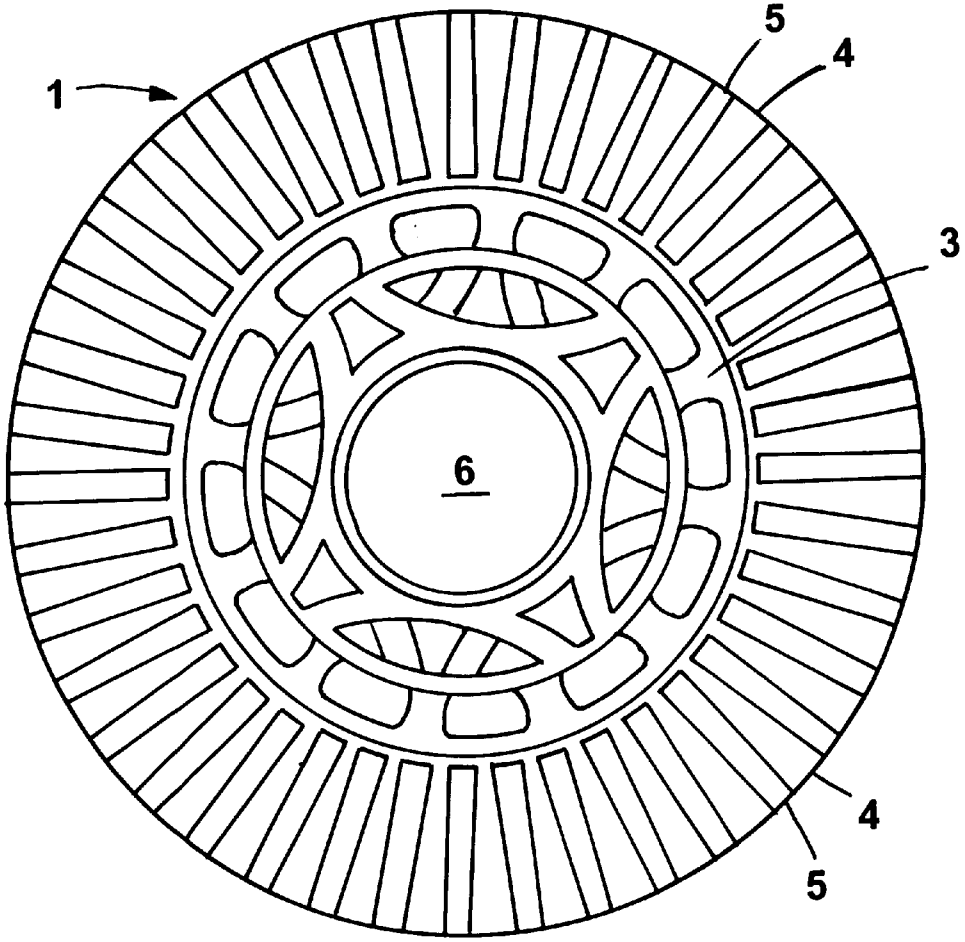
FIG. 4A is a radial cross-section of an in-line skate wheel of the present invention.
Figure 5B:
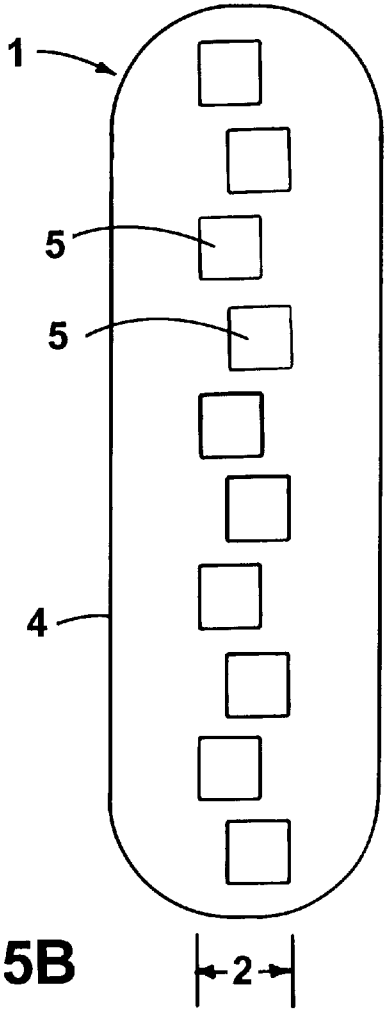
FIG. 5B is an axial plan view of the wheel depicted in FIG. 5A.
Figure 5A:
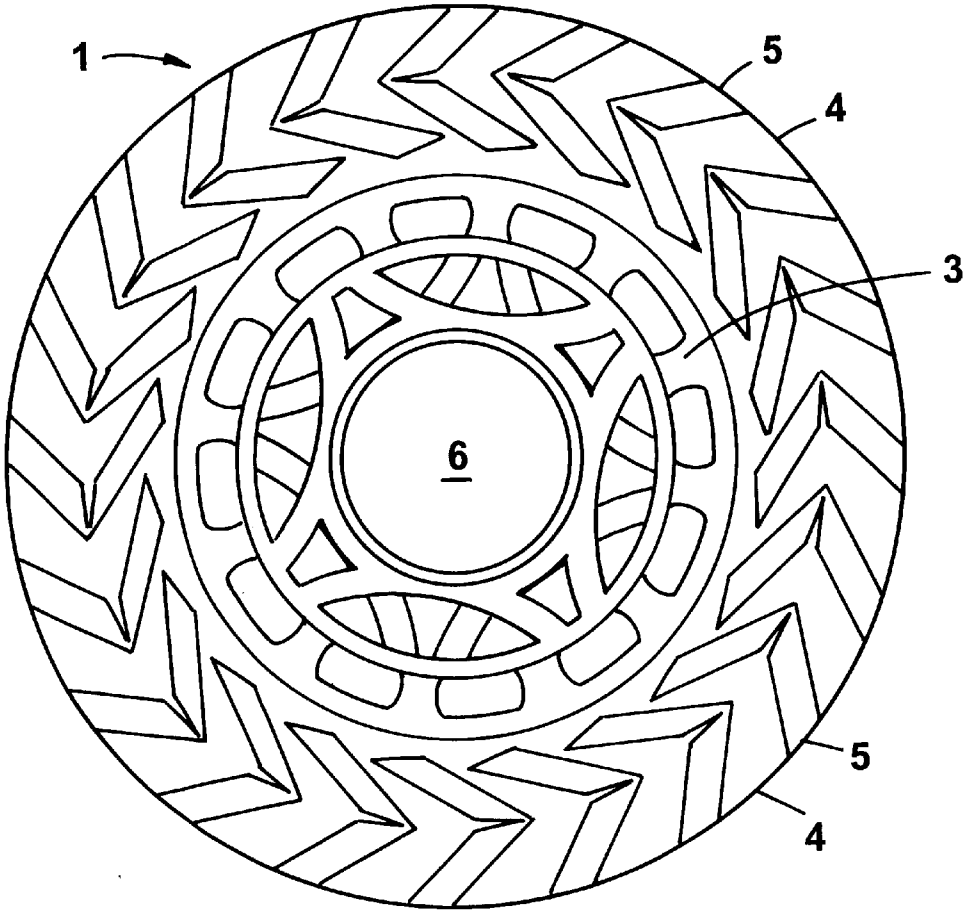
FIG. 5A is a radial cross-section of an in-line skate wheel of the present invention.

Referring to FIG. 2, a wheel 1 of the invention includes a high-friction surface material 4 and a low friction surface material 5. The wheel 1 includes a conventional hub 3 with a center hole 6. The low friction surface material 5 is arranged around the entire circumference of the wheel 1. The amount of contact between the high friction material 4 and the ground increases, and thus friction increases, as the wheel 1 is tilted significantly away from a vertical orientation.

A material suitable for use as the high friction surface material 4 is a castable thermoset polymer resin such as a castable thermoset polyurethane. Such material is exemplified by Vibrathane™ B625 (Uniroyal Chemical, Middletown, Conn.

A material suitable for use as the low friction surface material 5 is a thermoplastic polymer resin such as thermoplastic, injected-molded polyurethane. Such material is exemplified by Estane™ formulations (B.F. Goodrich, Cleveland, Ohio. Another preferred injection moldable polyurethane is commercially available as Estaloc™ (B.F. Goodrich).

FIGS. 3A–8B illustrate alternative embodiments. There is wide latitude in the size, shape, and arrangement of pieces of low friction surface material 5 incorporated into the wheel.

Figure 9:
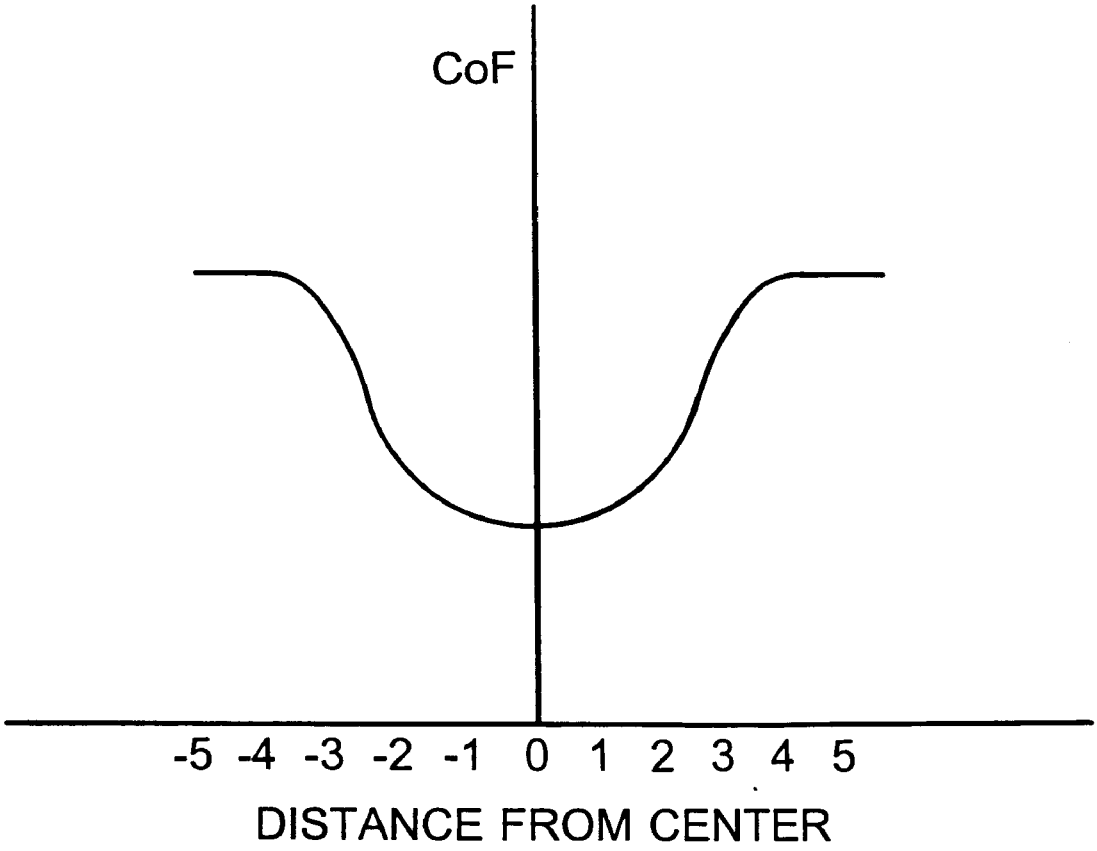
FIG. 9 is a graph of coefficient of friction as a function of distance from the center of the wheel, for a hypothetical wheel with a friction gradient. Distance from the center of the wheel is indicated in arbitrary units.

The low friction material 5 can be arranged so that the highest ratio of low friction surface area-to-high friction surface area occurs in the center of the wheel 1, and decreases with distance from the center. This results in a friction gradient, which enhances smoothness and control in stopping. FIG. 9 is a graph illustrating the relationship between coefficient of friction and distance from the center of a hypothetical wheel 1 of the present invention. Alternatively, the low friction material 5 can be arranged so that the highest ratio of low friction surface area-to-high friction surface area occurs on either side of the center of the wheel 1.

Figure 6B:
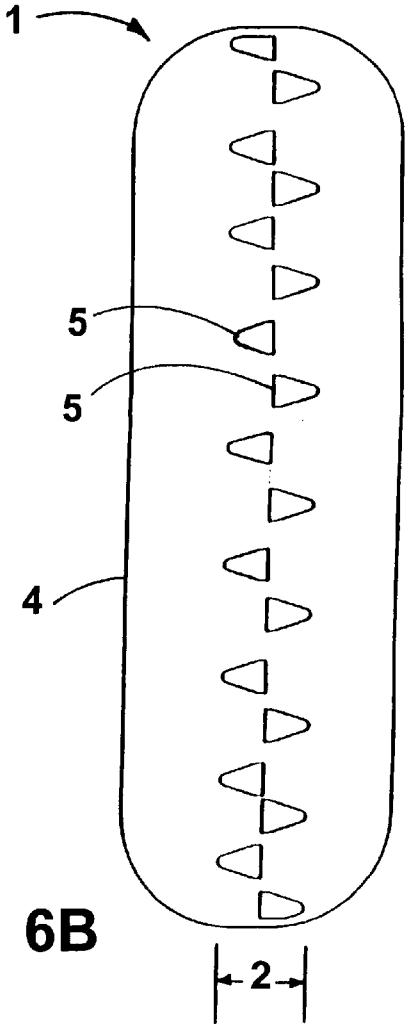
FIG. 6B is an axial plan view of the wheel depicted in FIG. 6A.
Figure 6A:
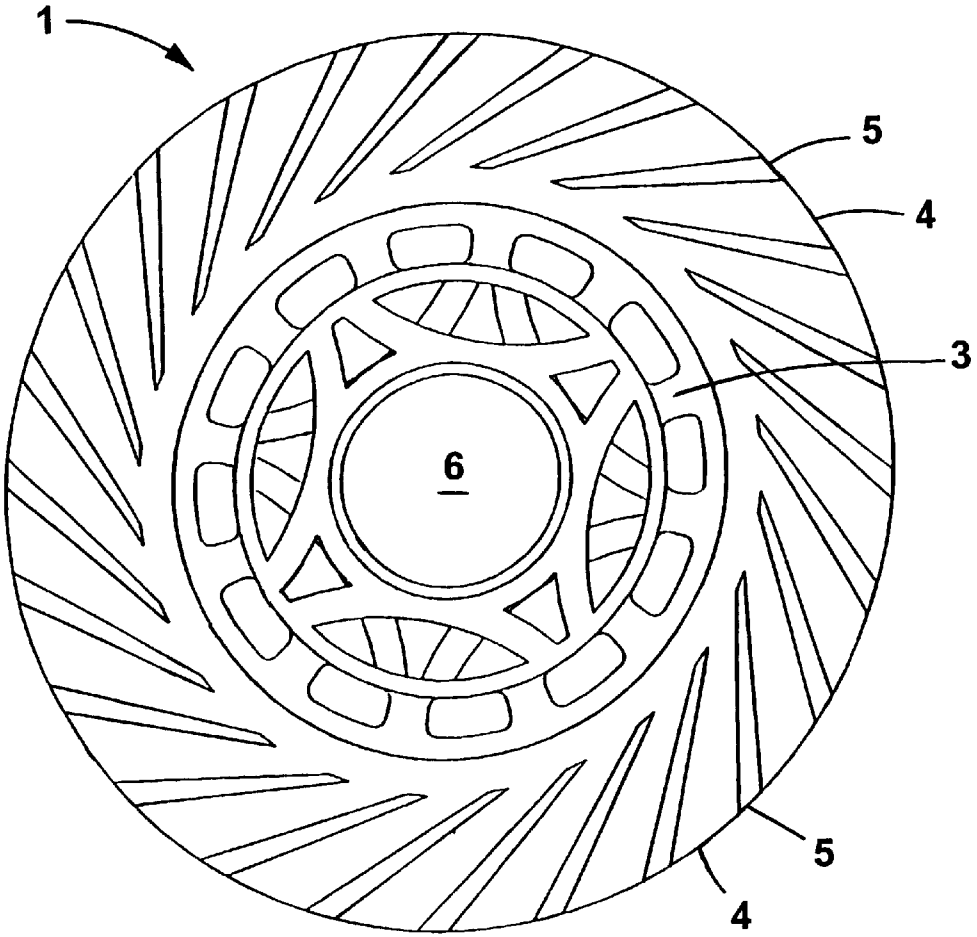
FIG. 6A is a radial cross-section of an in-line skate wheel of the present invention.
Figure 7B:
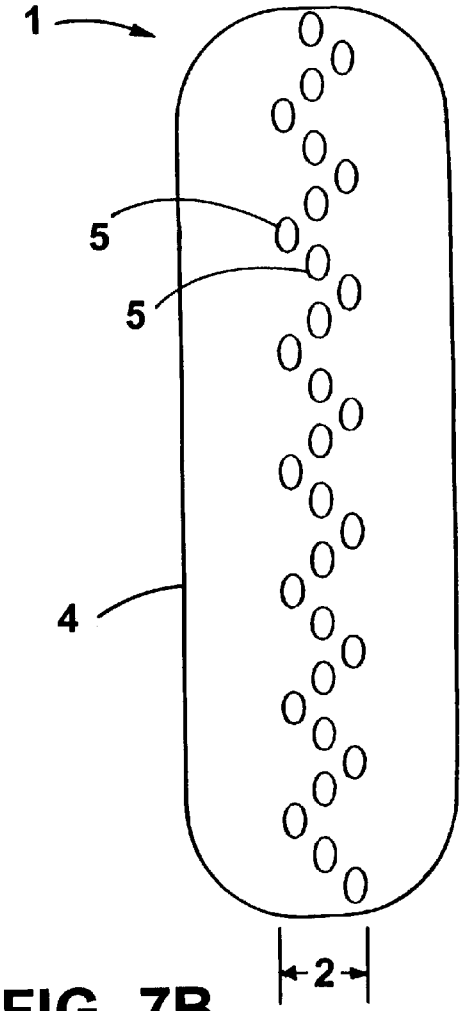
FIG. 7B is an axial plan view of the wheel depicted in FIG. 7A.
Figure 7A:
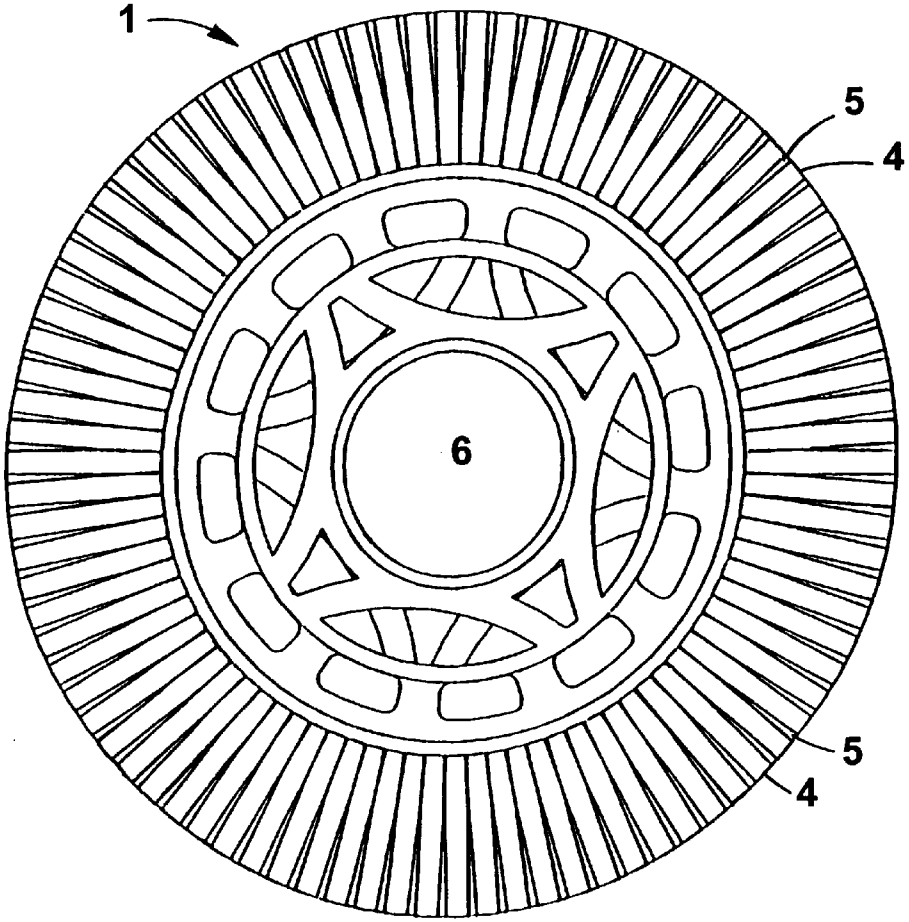
FIG. 7A is a radial cross-section of an in-line skate wheel of the present invention.
Figure 8B:
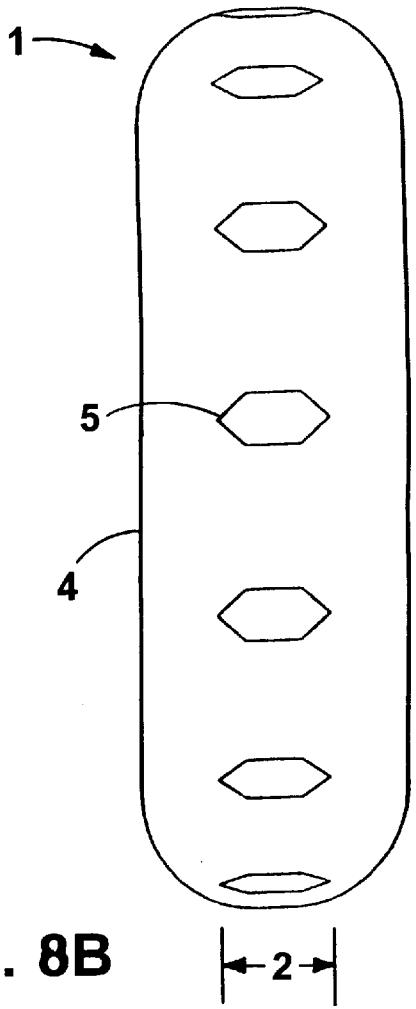
FIG. 8B is an axial plan view of the wheel depicted in FIG. 8A.
Figure 8A:
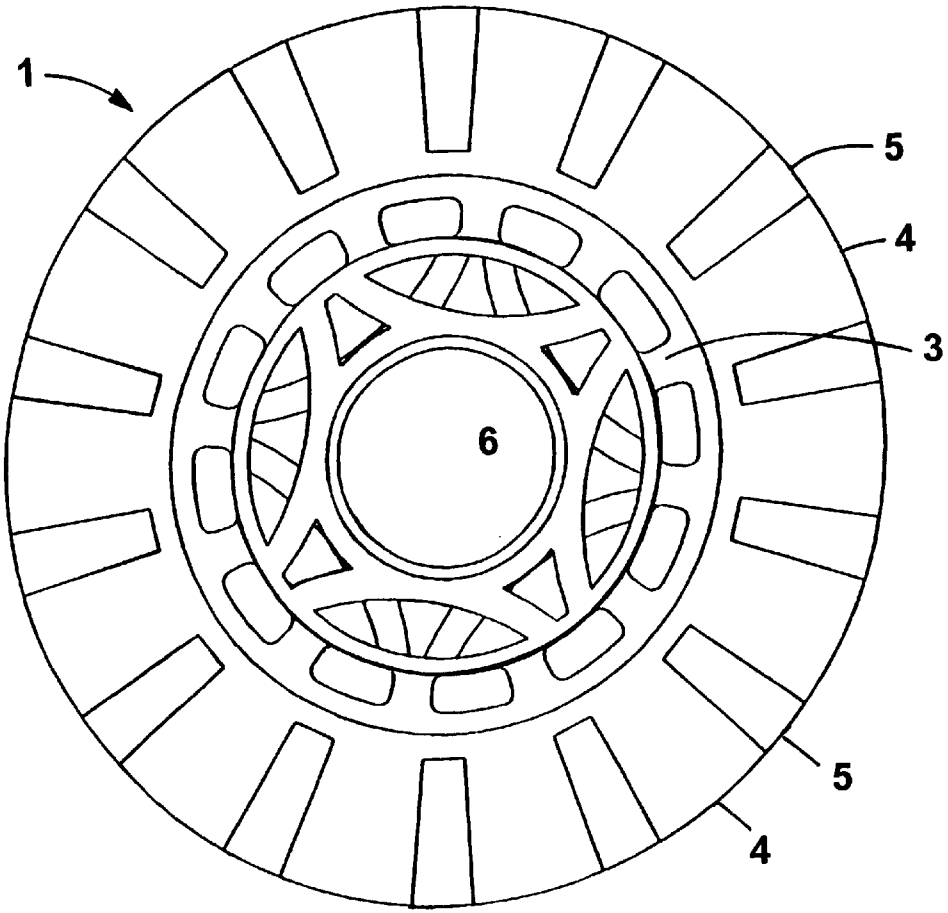
FIG. 8A is a radial cross-section of an in-line skate wheel of the present invention.

A friction gradient can be produced in various ways. For example, pieces of low friction material 5 can be tapered (as viewed end-on) and oriented so the taper narrows with distance from the center of the wheel 1 (FIGS. 6B and 8B). Alternatively, tapered or non-tapered pieces of low friction material 5 can be arranged to constitute a greater proportion of the wheel's surface near the center of the wheel 1 (FIGS. 3B, 4B, 5B, and 7B).

The invention encompasses low friction surface material 5 in the form of an inner ring with integral spokes radiating out to the wheel's surface, and a continuous ring at the wheel's surface. In preferred embodiments of the invention, however, the low friction surface material 5 is in the form of floating insets, i.e., pieces unattached to an inner ring or to each other. In general, the ride is smoother, quieter, and more comfortable when the low friction surface material 5 is incorporated as floating insets. Preferably, floating insets 5 extend into the wheel 1 at least half the distance from the wheel's surface to the wheel hub 3. When the floating insets 5 are arranged as spokes, the spokes can be angled (FIGS.

2A and 6A). In general, angling the spokes enhances the smoothness, and hence the comfort, of the ride.

The wheel can be made by the following general procedure. A mixture of a diisocyanate and a polyol is placed in a conventional wheel casting mold that contains a prefabricated low friction surface material containing an isocyanate-reactive functional group. The diisocyanate reacts with the polyol to produce a high friction material castable thermoset polyurethane in intimate contact with the low friction surface material.

Without intending to be limited by theory, it is believed that in addition to reacting with the polyol to produce the high friction polyurethane, the diisocyanate also reacts with the isocyanate-reactive functional groups on the low friction thermoplastic resin and on the high friction thermoset polyurethane. This covalently cross-links the low friction thermoplastic resin and high friction thermoset polyurethane through urea linkages or urethane linkages. Thus, the high friction surface material and the low friction surface material are covalently joined without the use of an adhesive layer between them.

The durable joining maintains the integrity of the wheel under the extreme stress associated with turning or skidding under the full weight of the skater. It also inhibits initiation and propagation of tearing.

EXAMPLE 1

Thermoset Polyurethane Casting

Butanediol (630 g) and trimethyol propane (50 g) were mixed in a 1000 ml container. The mixture (Curative A) was mechanically stirred (400 rpm) at 150° F. for one hour and then cooled to room temperature. Vibrathane™ B625 (Uniroyal Chemical, Middletown, Conn.) was heated to 160° F. and poured into a 1000 ml resin reactor. Curative A (68 g) was warmed to 100° F. and added to the resin reactor. This mixture was stirred for 60 seconds, poured into a conventional mold heated to 220° F. After 20 minutes of curing, the cast was removed from the mold and subjected to a 12-hour postcuring treatment in an oven at 180° F. A conventional amine catalyst and conventional pigment were included in the curing process.

EXAMPLE 2

Peel Testing

A slab, measuring 4.75"×4.75"×0.125", of Estane™ 58134 (thermoplastic polyurethane; B.F. Goodrich, Cleveland Ohio) was placed in a mold heated to 180° F. Castable thermoset polyurethane precursors (e.g., Vibrathane™ 625 prepolymer) and curatives (e.g., Curative A, above) were poured on top of the slab in the mold. After a 20-minute curing time, the slab was removed from the mold and placed in an oven heated to 128° F., for a 12-hour postcuring treatment. Each cured slab was cut into a test strip measuring of 4.75"×1"×1.25". An Instron™ device was used to perform peel strength measurements according to ASTM D429 method B, except that the stripping force was applied at an angle of 180° instead of 90°. The Instron head speed was 2 inches per minute.

Thermoset polyurethane having a final hardness of 83 Shore A was cast onto several Estane™ thermoplastic polyurethane formulations. The resulting interface between the two materials was then subjected to a peel test, to determine bond strength. Exemplary peel test results are presented in Table 1.

TABLE 1

| Thermoset Polyurethane | Hardness (Shore Å) | Bond Strength (pli) |
|---|---|---|
| Estane 58810 | 90 | 92 |
| Estane 58134 | 88 | 98 |
| Estane 58206 | 85 | >101 (urethane tearing) |
| Estane 58130 | 92 | >118 (urethane tearing) |
| Estane 58202 | 88 | 82 |
| Estane 588810 | 90 | >133 (urethane tearing) |
| Estane 58309 | 86 | 91 |
| Estane 58300 | 84 | >104 (urethane tearing) |
| Estane 58370 | 84 | >101 (urethane tearing) |
| Estane 58238 | 75 | 76 |

Other embodiments of the invention are within the following claims.

We claim:

1. A wheel for an in-line roller skate, the wheel having an outer, peripheral surface comprising first and second adjacent portions extending about the wheel, the first portion comprising a first material, and the second portion comprising a second material having a lower coefficient of friction than the first material and arranged in multiple, discrete regions spaced apart about the circumference of the wheel to define a series of alternating spaces therebetween, the discrete regions of second material arranged such that the proportion of the peripheral surface of the wheel formed of second material decreases toward said first portion, to provide variable traction as a function of wheel angle.

2. The wheel of claim 1 wherein said second portion is comprised of said first material with said discrete regions of second material surrounded by said first material occupying said alternating spaces.

3. The wheel of claim 1 wherein said first and second materials have about the same hardness.

4. The wheel of claim 3 wherein the hardnesses of both the first and second materials are between about 75 and 95 Shore A.

5. The wheel of claim 1, wherein said discrete regions of second material are equally spaced about the entire circumference of the wheel.

6. The wheel of claim 1 wherein the first material has a coefficient of friction of about 0.45 to 1.5, and the second material has a coefficient of friction of about 0.1 to 0.45.

7. The wheel of claim 1, wherein said high friction surface material comprises a castable thermoset polymer resin containing an isocyanate-reactive functional group, and said low friction surface material comprises a thermoplastic polymer resin containing an isocyanate-reactive functional group.

8. The wheel of claim 1, wherein said wheel comprises a hub;

a ring of said first material molded about the hub; and a series of floating insets of said second material within the ring of first material, the floating insets having inner ends spaced apart from the hub, and outer ends defining said discrete regions of second material at the peripheral surface of the wheel.

9. The wheel of claim 8 wherein said floating insets extend over at least half the radial distance from the peripheral surface of the wheel to the hub.

10. The wheel of claim 9 wherein the insets are angled with respect to the wheel radius.

11. The wheel of claim 1 wherein the discrete regions of second material are tapered, as viewed end-on, and oriented such that the taper narrows with distance from the center of the wheel.

12. A wheel for an in-line roller skate, the wheel having a peripheral surface and comprising a hub;

a high friction material molded about the hub; and multiple pieces of a low friction material molded as individual floating insets within the high friction material, the insets forming discrete areas of low friction material arranged about a skating portion of the peripheral surface of the wheel; wherein said low and high friction materials have about the same hardness.

13. The wheel of claim 12 wherein the hardnesses of both the low and high friction materials are between about 75 and 95 Shore A.

14. The wheel of claim 12 wherein said discrete areas of low friction material are equally spaced about the entire circumference of the wheel.

15. The wheel of claim 12 wherein the high friction material comprises a castable thermoset polyurethane and the low friction material comprises a thermoplastic polyurethane, the low and high friction materials being durably joined by covalent bonds.

16. The wheel of claim 12 wherein the peripheral surface of the wheel includes a braking portion adjacent said skating portion, the braking portion being substantially void of said low friction material.

17. A wheel for an in-line roller skate, the wheel having an outer, peripheral surface comprising first and second adjacent portions extending about the wheel, the first portion comprising a first material, and the second portion comprising a second material having a lower coefficient of friction than the first material and arranged in discrete regions, the discrete regions of second material arranged such that the proportion of the peripheral surface of the wheel formed of second material decreases toward said first portion, to provide variable traction as a function of wheel angle, wherein said first and second materials have about the same hardness.

18. A wheel for an in-line roller skate, the wheel having an outer, peripheral surface comprising first and second adjacent portions extending about the wheel, the first portion comprising a first material, and the second portion comprising a second material having a lower coefficient of friction than the first material and arranged in discrete regions, the discrete regions of second material arranged such that the proportion of the peripheral surface of the wheel formed of second material decreases toward said first portion, to provide variable traction as a function of wheel angle, wherein said wheel comprises a hub;

a ring of said first material molded about the hub; and a series of floating insets of said second material within the ring of first material, the floating insets having inner ends spaced apart from the hub, and outer ends defining said discrete regions of second material at the peripheral surface of the wheel.

19. A wheel for an in-line roller skate, the wheel having an outer, peripheral surface comprising first and second adjacent portions extending about the wheel, the first portion comprising a first material, and the second portion comprising a second material having a lower coefficient of friction than the first material and arranged in discrete regions, the discrete regions of second material arranged such that the proportion of the peripheral surface of the wheel formed of second material decreases toward said first portion, to provide variable traction as a function of wheel angle, wherein the discrete regions of second material are tapered, as viewed end-on, and oriented such that the taper narrows with distance from the center of the wheel.

* * * * *